US008632101B2

(12) United States Patent
Mallol et al.

(10) Patent No.: US 8,632,101 B2
(45) Date of Patent: Jan. 21, 2014

(54) METHOD FOR SECURING A COLOURED OPAQUE OBJECT

(75) Inventors: Stephane Mallol, Provins (FR); Ivan Thierry, Jouy sur Morin (FR)

(73) Assignee: Arjowiggins Security, Paris (FR)

( * ) Notice: Subject to any disclaimer, the term of this patent is extended or adjusted under 35 U.S.C. 154(b) by 0 days.

(21) Appl. No.: 13/147,532

(22) PCT Filed: Feb. 3, 2010

(86) PCT No.: PCT/IB2010/050502
§ 371 (c)(1),
(2), (4) Date: Nov. 17, 2011

(87) PCT Pub. No.: WO2010/089702
PCT Pub. Date: Aug. 12, 2010

(65) Prior Publication Data

US 2012/0068451 A1 Mar. 22, 2012

(30) Foreign Application Priority Data

Feb. 3, 2009 (FR) ..... 09 50657

(51) Int. Cl.
*B42D 5/00* (2006.01)
*G09F 3/00* (2006.01)

(52) U.S. Cl.
USPC ..... 283/81; 283/92; 283/113; 40/310

(58) Field of Classification Search
USPC ..... 283/81, 92, 113; 40/310; 235/491; 428/29
See application file for complete search history.

(56) References Cited

U.S. PATENT DOCUMENTS

| | | | | | |
|---|---|---|---|---|---|
| 1,479,337 | A | | 1/1924 | Temple | |
| 2,021,141 | A | | 11/1935 | Boyer | |
| 2,262,492 | A | * | 11/1941 | Farrell | 283/81 |
| 2,368,815 | A | * | 2/1945 | Farrell | 283/92 |
| 4,307,899 | A | | 12/1981 | Hoppe | |
| 5,118,526 | A | | 6/1992 | Allen et al. | |
| 5,275,870 | A | | 1/1994 | Halope et al. | |
| 5,346,259 | A | * | 9/1994 | Mocilnikar et al. | 283/81 |
| 5,605,738 | A | | 2/1997 | McGinness et al. | |
| 5,651,615 | A | * | 7/1997 | Hurier | 283/92 |
| 6,165,592 | A | * | 12/2000 | Berger et al. | 283/92 |

(Continued)

FOREIGN PATENT DOCUMENTS

| | | |
|---|---|---|
| DE | 37 18 452 A1 | 1/1988 |
| DE | 39 20 378 C1 | 1/1991 |

(Continued)

OTHER PUBLICATIONS

International Search Report of International Application No. PCT/IB2010/050502 dated Jun. 22, 2010.

(Continued)

*Primary Examiner* — Kyle Grabowski
(74) *Attorney, Agent, or Firm* — O'Brien Jones, PLLC

(57) ABSTRACT

The invention relates to a method for securing a colored or uncoloured translucent or opaque object (1), in which a sticker (2) is affixed to the back of the object (1), said sticker comprising: a substrate including a watermark or pseudo-watermark (4) which is sufficiently transparent to allow the object (1) to be seen through the watermark or pseudo-watermark (4); and a luminescent agent which is positioned at least partially over the watermark or pseudo-watermark (4) between the watermark or pseudo-watermark (4) and the object (1).

10 Claims, 1 Drawing Sheet

(56) References Cited

U.S. PATENT DOCUMENTS

| | | | | |
|---|---|---|---|---|
| 6,241,289 | B1 | 6/2001 | Kulper et al. | |
| 6,326,071 | B1 | 12/2001 | Francoeur | |
| 6,402,888 | B1 * | 6/2002 | Doublet et al. | 162/140 |
| 6,630,055 | B1 | 10/2003 | Goguelin et al. | |
| 6,991,846 | B2 | 1/2006 | Mallol et al. | |
| 7,086,666 | B2 * | 8/2006 | Richardson | 283/92 |
| 2007/0128418 | A1 | 6/2007 | Rosset | |
| 2009/0186205 | A1 | 7/2009 | Doublet et al. | |

FOREIGN PATENT DOCUMENTS

| | | | |
|---|---|---|---|
| DE | 197 47 000 | C1 | 12/1998 |
| DE | 103 04 795 | A1 | 8/2004 |
| DE | 10 2005 022 518 | A1 | 11/2006 |
| EP | 0 203 499 | A2 | 12/1986 |
| EP | 0 655 316 | A2 | 5/1995 |
| EP | 0 773 527 | A1 | 5/1997 |
| EP | 1 036 665 | A1 | 9/2000 |
| EP | 1 122 360 | A1 | 8/2001 |
| EP | 1 518 661 | A2 | 3/2005 |
| EP | 1 607 520 | A2 | 12/2005 |
| FR | 2 353 676 | A1 | 12/1977 |
| FR | 2 901 813 | A1 | 12/2007 |
| GB | 1 489 084 | | 10/1977 |
| WO | WO 91/07285 | A1 | 5/1991 |
| WO | WO 97/17493 | | 5/1997 |
| WO | WO 99/14433 | | 3/1999 |
| WO | WO 2007/016148 | A2 | 2/2007 |

OTHER PUBLICATIONS

Written Opinion for International Application No. PCT/IB2010/050502 dated Jun. 22, 2010.

Raneese, R. Van (Editor), Optical Document Security, 1998, pp. 20-22 and 114-117, Second Edition, Artech House.

Office Action from corresponding European Application No. EP 10703521.4, dated Jul. 9, 2013.

Auszug aus Wikipedia, Stichwort "Wasserzichen" http://de.wikipedia.org/wiki/Wasserzeichen (referenced Jun. 21, 2013).

* cited by examiner

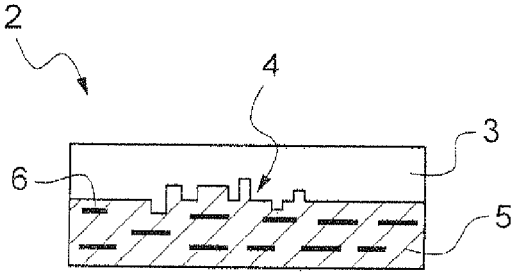
Fig.1
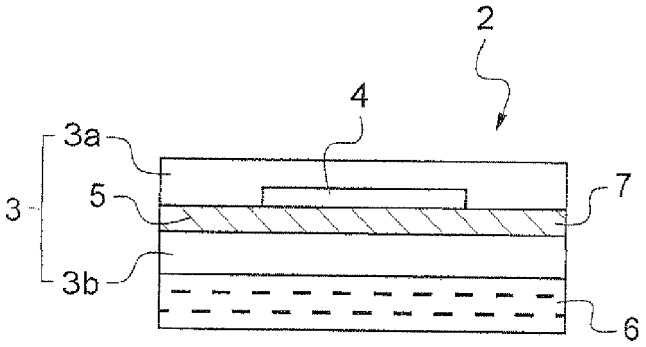
Fig.2
Fig.3
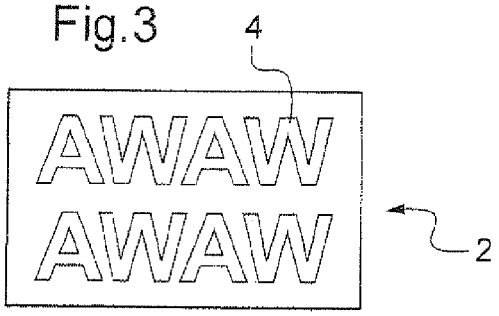
Fig.4
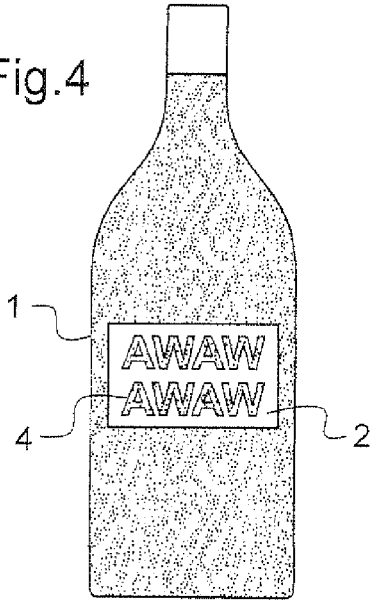
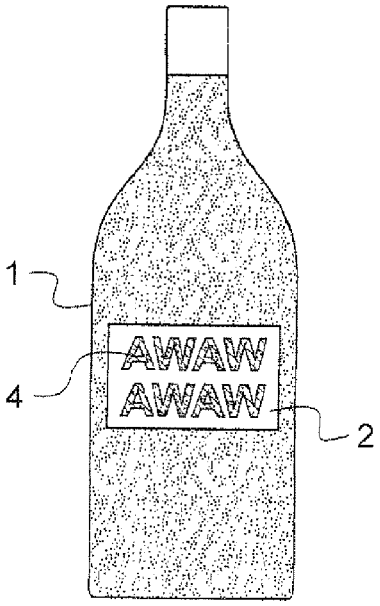
Fig.5

METHOD FOR SECURING A COLOURED OPAQUE OBJECT

This is a national stage application under 37 U.S.C. 371(c) of International Application No. PCT/IB2010/050502, filed Feb. 3, 2010, which claims priority to French Application No. FR 09 50657, filed Feb. 3, 2009 in France.

The present invention relates to labels used to secure objects, and more particularly to labels intended to be placed on bottles containing wine or alcoholic beverages.

The term "label" is understood to mean a medium, for example made of paper, which can be held in place on an object using an adhesive. A label is generally used to identify an object and/or its content.

To secure an object, it is known to use various security means such as watermarks, which make it possible to authenticate the object by observation in transmitted light.

Application DE 10 2005 022 518 A1 describes a security paper, comprising a watermark, printed with an ink that fluoresces under ultraviolet (UV) light. The paper is transparent to UV only in the watermarked region, and it may be used to produce labels.

Application EP 0 773 527 describes a label comprising a security thread that may be seen in windows between which dark watermarks forming strips perpendicular to the thread appear.

There is a need for new security features, with regard to the use of labels to secure objects, which are easily seen while providing a satisfactory level of security.

There is in particular a need for security measures, on an opaque or colored object, which may be seen by transparency and which are easy to implement.

The invention aims to meet all or some of these needs.

According to one of its aspects, one subject of the invention is a method for securing an opaque or translucent, colored or colorless, object, in which a label is bonded via its backside to the object, the label comprising:

- a substrate comprising a watermark or pseudo-watermark having a degree of transparency such that the object may be seen through the watermark or pseudo-watermark; and
- a luminescent agent superposed at least partially on the watermark or pseudo-watermark and located between the watermark or pseudo-watermark and the object.

The translucent nature of the object may be quantified by measuring the opacity of the object. In particular the translucence is the ability of an object to let light pass through it and a translucent object has an opacity that is strictly less than 100%. The opacity may be measured according to standard ISO 2471. It may be less than or equal to 80%, preferably 60%, more preferably 40% and even more preferably 30%.

By virtue of the invention it is possible to verify the authenticity of the object by observing the watermark or pseudo-watermark, which has a degree of transparency such that the object may be seen through it.

In particular, the transparency of the watermark or pseudo-watermark may allow properties, especially the color, of the underlying object to be observed under reflected white light and/or properties, especially the color, of the luminescent agent to be observed, through the watermark or pseudo-watermark, under reflected light that excites the luminescence, especially under ultraviolet light (UV) and/or infrared light (IR).

Substrate

The term "substrate" is understood to mean a sheet possibly comprising one or more fibrous layers and/or polymers.

The substrate may comprise a fibrous layer, for example based on plant fibers, for example cellulose fibers, in particular cotton fibers, and/or synthetic fibers such as for example polyamide and/or polyester fibers.

The substrate may also comprise a polymer layer which may for example take the form of a film. The film may or may not be cellular. By way of example, the polymer layer may comprise a film of polyvinyl chloride (PVC), polyethylene terephthalate (PET), polycarbonate (PC), polyester carbonate (PEC) polyethylene glycol terephthalate (PEGT), acrylonitrile butadiene styrene (ABS) or a light-collecting film, for example of the waveguide type, for example a polycarbonate-based luminescent film sold by Bayer under the trade name LISA®.

The substrate may comprise one or more, identical or different, watermarks or pseudo-watermarks.

Preferably, the substrate layer comprising the one or more watermarks or pseudo-watermarks is non-luminescent, in particular it neither fluoresces nor phosphoresces.

Watermark or Pseudo-Watermark

It is known to use a watermark or pseudo-watermark to secure an object or a security document. Such a use has been described many times in publications of the prior art.

The presence of a watermark or pseudo-watermark is supposed to make it impossible to reproduce the medium containing it by optical means such as photocopying, photography or scanning, because the copy would not contain the watermark or pseudo-watermark of the original medium.

The expression "watermark or pseudo-watermark" is, according to the invention, understood to mean an image that is contained in the thickness of the substrate.

The watermark or pseudo-watermark may be produced in various ways known to a person skilled in the art, for example in a fibrous and/or polymer substrate.

The watermark may be a design etched or pressed into the substrate during its manufacture in a cylinder-mold paper machine. Such a watermark may for example be seen by transparency by creating thinner and thicker regions in the pulp during manufacture of the substrate in the cylinder-mold paper machine, using a relief or hollow imprint on the forming wire of the cylinder mold.

The watermark may also be formed at the point where the substrate is pressed in a Fourdrinier paper machine using watermarks etched in relief on a dandy roll, certain regions of the substrate being strongly pressed and water, contained in the fibers during formation of the substrate at the wet end, being removed.

Preferably, the watermark borne by the substrate is a light watermark, which is especially very transparent. In this case, the light regions of the watermark have a mass per unit area that is strictly lower than that of vellum.

The watermark may also be a halftone watermark comprising light regions having a mass per unit area that is strictly lower than that of vellum. The halftone watermark may be produced, using the technique described in patent application EP 1 122 360, by creating a set of light regions (having a mass per unit area that is lower than that of the vellum of the substrate) arranged so as to form a halftone image comprising light and dark tones on the substrate, especially obtained using a set of masks fixed to the dewatering wire of the paper machine. Such a watermark recreates the visual aspect of a conventional, countersunk watermark and provides all the usual security features of a conventional countersunk watermark. The watermark appears locally in transmitted light as a juxtaposition of light and dark regions that may be distinguished from each other, the latter in fact having the same mass per unit area as the vellum but appearing dark when compared to the neighboring light regions due to a contrast effect.

The presence of a luminescent agent superposed at least partially on a light or halftone watermark may make it possible to see the light and/or dark shades of the watermark.

The watermark may also be produced using the method described in application FR 2 901 813. This method is used to produce recesses in a fibrous ply, so as to form a watermark, by attaching parts preventing filtration to the wire of a cylinder mold, for example a metal part, especially an electrotype (i.e. a plate made of metal, generally bronze), an adhesive part or a resin part. The shape of the part may thus define the shape of the recess or recesses. It is also envisioned to use parts having various shapes to make recesses of different shapes.

Advantageously, the watermark or pseudo-watermark is sufficiently transparent that it is possible to see the opaque or colored object, and optionally the luminescent agent, through it.

In particular, the substrate may comprise a watermark or pseudo-watermark having light regions with a maximum depth ranging for example from 50 to 90% and preferably from 70 to 80% of the maximum thickness of the vellum. All the light regions may have substantially the same depth.

Pseudo-watermarks reproduce the appearance of a watermark by way of opacity differences. These pseudo-watermarks may be obtained mechanically by applying a pressure with or without heating and/or chemically by application of a composition, for example by locally increasing the transparency of the paper using transparentizing substances. The density of fibrous material between the lightest and darkest regions of the pseudo-watermark may be uniform, unlike a conventional watermark.

The pseudo-watermark may correspond to one or more recesses created in the substrate, for example using embossments or electrotypes on the wire of a cylinder mold.

The one or more recesses may also be produced using a paper making method for manufacturing a sheet comprising at least one ply of a fibrous substrate and at least one fibrous ribbon, in which the ribbon is introduced into a fibrous suspension in a cylinder-mold paper machine used to produce the ply, or introduced in direct contact with the cylinder mold or by contact with the formed ply, the point of introduction of the ribbon being chosen so as to create at least one depression, i.e. a recess, on the sheet in the location of the ribbon, the depression being due to the ribbon limiting dewetting of the fibrous suspension.

The pseudo-watermark may be produced in the finished substrate by mechanical and/or chemical means by applying certain products, the pseudo-watermark still being seen by transparency.

A pseudo-watermark may for example be produced by depositing or printing on defined regions of the substrate a composition that modifies the transparency of the substrate, especially so as to produce light regions and dark regions, similar to those of a watermark, without however delivering a result that has subtlety and variations in luminosity that are comparable to those of a conventional watermark.

It is possible for example to transparentize the finished substrate by applying for example, in defined regions, a composition that is generally fatty and that permanently transparentizes the substrate, such as for example a composition made from oil and a transparent inorganic material such as described in U.S. Pat. No. 2,021,141 or such as for example a composition in the form of a wax combined with a solvent, as described in U.S. Pat. No. 1,479,337.

It is also possible to transparentize the finished substrate by local application of a heat-transferred wax, as described in U.S. Pat. No. 5,118,526, of a radiation-curable transparentizing fluid, as described in GB 1 489 084, or of a composition based on polyether, aliphatic isocyanate and alcohol, applied by printing, as described in DE 3 920 378.

It is also possible to use a substrate comprising a hot-melt material the transparency of which varies when heat is applied locally, such as for example polyethylene as described in patent EP 0 203 499.

It is possible to opacify the finished substrate, without however making it completely opaque, by applying an opacifying agent which increases the opacity of the substrate in defined regions, such as for example described in patent application FR 2 353 676. The opacifying agent may for example be an aqueous suspension of a pigment, a filler or a solution of a chemical compound, of a colored compound or of a dye. This agent may be applied during the manufacture of the substrate, to the fibrous web before its removal from the wire, so that the agent penetrates into the interstices of the web and modifies the opacity of the web to be treated in chosen regions after drying. This manufacturing technique has the drawback of needing special roller systems to apply the agent, and it preferably employs a suction device to force the agent to penetrate into the interstices of the web.

It is also possible to produce a pseudo-watermark using the method described in document W. WALENSKI, "Watermarks and Those that Are Not", Druckspiegel 52, No 3: 66-68 (March 1997). This document describes a method for producing a pseudo-watermark on an uncoated paper by applying a marking piece having the pattern of the pseudo-watermark, under heat and pressure, to a rewetted paper sheet.

It is also possible to produce a pseudo-watermark on an uncoated paper by applying a rewetting solution to one or more defined regions of the paper under heat and pressure so as to evaporate the solution and densify the paper in the defined region or regions.

International application WO 97/17493 also describes the manufacture of coated paper comprising pseudo-watermarks resulting from a variation in the weight of the coating applied in defined regions, this induces a thickness and opacity variation in the regions where the weight of the coat is reduced or increased.

International application WO 1999/014433 also describes another method for manufacturing a pseudo-watermark on a coated paper, which makes it possible to create an image in the paper after the drying step that follows the last coating operation, by implementing steps in which a rewetting solution is applied to at least one side of the coated paper, in one or more defined regions, and pressure and heat are applied to the region or regions of the coated paper so as to evaporate the solution and densify the coated paper in the region or regions relative to the rest of the paper.

The pseudo-watermark may finally be produced mechanically by making marks by mechanically embossing defined regions of the fibrous layer, as described in patent DE 3 718 452.

The pseudo-watermark can even be produced in a polymer layer via application of a composition that modifies its transparency.

Application WO 91/07285 describes printing a synthetic medium with a composition that modifies the opacity of the medium and that contains at least one inorganic filler and at least one binder or a soluble or pigment-based colorant. The composition is applied in defined regions and the medium is then coated over its entire surface with a printable pigment-based composition using coating methods known to a person skilled in the art.

U.S. Pat. No. 4,307,899 describes an authentication card comprising an imprint formed on a, preferably plastic, medium by printing partially superposed colored layers. The regions printed with a single layer appear light in transmitted light and dark in reflected light, and the regions printed with several superposed layers appear dark in transmitted light and light in reflected light, thus producing a watermark effect. By modifying the number of layers, it is possible to obtain multitone effects.

The pseudo-watermark can also be produced in a polymer layer using mechanical means.

It is possible, for example, to produce a pseudo-watermark on a sheet of a polymer material by passing the latter between two rollers, one of which bears hollow or relief motifs so as to form an imprint as described in EP 0 655 316. The sheet is then oriented by stretching so that, under transmitted light, the motifs appear in black and white, corresponding to the relief or hollow regions on the roller.

International application WO 2007/016148 also describes a plastic layer that may be deformed, especially stamped by embossing or de-embossing to form an image that appears like a watermark, and which is then laminated without the formed image being damaged.

The pseudo-watermark may finally be produced on a polymer layer using electromagnetic radiation, such as, for example, a laser.

Application EP 1 518 661 describes, for example, a method for producing a pseudo-watermark on a spooled polymer sheet by electromagnetic irradiation of certain regions and stretching of the sheet so as to obtain a stretched sheet having transparent regions corresponding to the irradiated regions.

Luminescent Agent

The luminescent agent may be fluorescent or phosphorescent under UV and/or under IR.

The luminescent agent may for example be a luminescent pigment, especially a fluorescent or phosphorescent pigment.

The luminescent agent may for example be a yellow fluorescent pigment sold by Honeywell under the trade name Lumilux® D140.

The luminescent agent may comprise one or more luminescent pigments. For example, when the luminescent agent is incorporated in an adhesive layer comprising an adhesive for ensuring the bonding of the label to the object, or an adhesive layer making it possible to laminate two sheets forming the substrate, the concentration of luminescent pigments relative to the total weight of the composition of the adhesive layer may be as high as 10%.

In particular, inorganic luminescent pigments may be incorporated in a concentration lying between 3 and 10%, preferably substantially equal to 5%, and organic luminescent pigments may be incorporated in a concentration lying between 1 and 10%, preferably substantially equal to 3%.

The luminescent agent may completely cover the watermark or pseudo-watermark. The luminescent agent may extend over all of the backside of the label. In particular, the luminescent agent may not be present in a security wire incorporated in the substrate.

Adhesive

The label may comprise an adhesive layer, especially on the backside of the substrate, comprising an adhesive ensuring the bonding of the label to the object.

The adhesive layer may or may not contain the luminescent agent.

The adhesive layer may be colored or opaque.

The adhesive layer may be translucent.

The adhesive may be a pressure-sensitive adhesive (PSA).

The adhesive may also be a heat-sealing coating, for example a heat-sealing lacquer, a UV-curable agent, a radiation-curable adhesive, a lacquer with a solvent base, a polyester lacquer for example, or an adhesive in aqueous phase, inter alia. The adhesive may be polyvinyl acetate (PVA).

The adhesive may for example be a thermoplastic film, for example a polyethylene film, which may be used to fix the label to the object.

The substrate may for example by precoated on its backside with a pressure-sensitive or heat-activated adhesive composition, this composition being applied hot or cold, in liquid form, by extrusion or by lamination.

The substrate may comprise a first sheet bearing the watermark or pseudo-watermark, a second sheet and an adhesive layer, containing the luminescent agent, binding the two sheets. The adhesive layer may be such as described above. Another adhesive layer may be borne by the second sheet, opposing the first, to ensure attachment to the object.

The second sheet may be colored, opaque or translucent, and the adhesive layer between the two sheets may for example be transparent.

Object

According to another of its aspects, another subject of the invention is an object that may be authenticated using a method as described above.

The object may have an opacity or a color, preferably a dark color, which allows it to be seen through the watermark or pseudo-watermark in the substrate.

The object may thus have any shade of opacity and/or color allowing it to be discerned from the opacity and/or color of the substrate, so that the nature, color or opacity of the object may be seen through the watermark or pseudo-watermark.

The object may for example be covered at least partially on its surface by an opaque or colored coating onto which the label is bonded. The coating may even be translucent.

The object may also be, at least partially, transparent or translucent and contain an opaque or colored product that makes it possible to see the watermark or pseudo-watermark.

The object is for example a bottle. The bottle may for example contain a wine or an alcoholic beverage, especially a red wine the color of which makes it easier to see the watermark or pseudo-watermark by transparency.

The label may be printed using any conventional printing method, such as, for example, flexography, offset printing, screen printing, typography or digital printing, such as, for example, electrophotography, inkjet printing or heat printing.

The label, especially the substrate, may advantageously have properties that withstand the effects of chemical stress, moisture, cold, mold (often present in cellars) and/or mechanical stress such as rubbing, so as to be very durable.

Likewise, the adhesive layer ensuring the bonding of the label to the object may have properties that withstand the effects mentioned above.

The invention will be better understood on reading the following description of nonlimiting, exemplary implementations of the invention and on examining the appended partial schematic figures, in which:

FIG. 1 shows, in cross section, an exemplary label that may be used in the method according to the invention;

FIG. 2 shows, in cross section, a variant embodiment of a label that may be used in the method according to the invention;

FIG. 3 shows a top view of the labels of FIGS. 1 and 2;

FIG. 4 shows an object, comprising a label according to FIG. 1 or 2, for implementing the method according to the invention, the object be observed under normal lighting; and FIG. 5 shows the object of FIG. 4 observed under luminescent lighting.

Shown in FIG. 1, in cross section, is an exemplary label 2 than may be used in a method according to the invention.

The label 2 comprises a substrate 3, a watermark or pseudo-watermark 4, and an adhesive layer 6 placed on the backside of the substrate 3, the adhesive layer 6 containing a luminescent agent 5.

The adhesive layer 6 may for example comprise a pressure-sensitive adhesive (PSA).

The luminescent agent 5 may for example be a yellow fluorescent pigment sold by Honeywell under the trade name Lumilux® D140.

The label 2 may thus be bonded to an object 1 for implementing the method according to the invention by way of the adhesive layer 6 containing the luminescent agent 5.

Shown in FIG. 2 is a variant embodiment of a label 2 that may be used in a method according to the invention.

The label 2 comprises a substrate 3 on the backside of which an adhesive layer 6 figures, possibly for example comprising a PSA adhesive.

The substrate 3 comprises a first sheet 3*a*, comprising a watermark or pseudo-watermark 4, a second sheet 3*b* and an adhesive layer 7 containing a luminescent agent 5 binding the two sheets 3*a* and 3*b* to each other.

The luminescent agent 5 may be the same as that described for FIG. 1.

The label 2 may thus be bonded to an object 1 for implementing the method according to the invention by way of the adhesive layer 6.

FIG. 3 shows a top view of a label 2 according to FIG. 1 or FIG. 2.

In this figure, the watermark or pseudo-watermark may be seen, taking for example the form of the letters "AW" repeated a number of times.

Preferably, the watermark 4 corresponds to a halftone watermark or a light watermark, having a degree of transparency such that the object 1 may be seen through it. In particular, the watermark 4 may have a maximum depth ranging from 50 to 90% of the thickness of the vellum. Shown in FIG. 4 is an exemplary object 1, comprising a label 2 according to FIG. 1 or 2, for implementing the security method according to the invention.

The object 1 is in this example a bottle, for example a bottle of wine comprising for example a red wine having a hue that is sufficiently dark that the color of the wine may be seen through the watermark or pseudo-watermark 4.

FIG. 4 more particularly shows the bottle 1 seen under normal lighting. In this case, it may be seen that it is possible to observe the red color of the wine contained in the bottle 1 through the watermark or pseudo-watermark 4.

FIG. 5 shows the bottle 1 and the label 2 of FIG. 4 when seen under luminescent lighting, for example under UV lighting. In this case, it may be seen that it is possible to observe both the red color of the wine contained in the bottle 1, through the watermark or pseudo-watermark 4, and the color of the luminescent agent 5, especially a yellow color in the case of a fluorescent pigment such as described above.

The security method according to the invention thus enables two levels of security to be provided at the same time, by observing the color or the opacity of the object 1 through the watermark or pseudo-watermark 4 under normal lighting, and by observing the luminescent agent 5 as well, optionally in combination with the color or opacity of the object 1, under luminescent lighting.

The expressions "comprising a" and "containing a" are understood to be synonymous with "comprising at least one" and "containing at least one", respectively.

The invention claimed is:

1. A method for securing an opaque or translucent, colored or colorless object, the method comprising:

bonding a label to the object, wherein the label comprises:

a first adhesive layer configured to bond the label to the object; and a substrate comprising a first sheet bearing a watermark or pseudo-watermark, a second sheet, and a second adhesive layer containing a luminescent agent binding the first and second sheets together, the watermark or pseudo-watermark having a transparency sufficient to permit observation of the object through the watermark or pseudo-watermark, wherein the luminescent agent is superposed at least partially on the watermark or pseudo-watermark and located between the watermark or pseudo-watermark and the object.

2. The method as claimed in claim 1, wherein the luminescent agent is fluorescent under ultraviolet lighting.

3. The method as claimed in claim 1, wherein the luminescent agent is fluorescent under infra-red lighting.

4. The method as claimed in claim 1, wherein bonding the label comprising a substrate comprises bonding a label comprising a substrate comprising a watermark or pseudo-watermark having a maximum depth ranging from 50% to 90% of the thickness of vellum.

5. The method as claimed in claim 1, wherein the watermark is a halftone watermark.

6. The method as claimed in claim 1, wherein the watermark is a light watermark.

7. The method as claimed in claim 1, wherein bonding the label to the object comprises bonding the label to a bottle.

8. The method as claimed in claim 7, wherein bonding the label to the bottle comprises bonding the label to a bottle containing wine or an alcoholic beverage.

9. The method as claimed in claim 1, wherein the luminescent agent is completely superposed on the watermark or pseudo-watermark.

10. The method as claimed in claim 1, wherein the luminescent agent extends over all of a backside of the label.

* * * * *

UNITED STATES PATENT AND TRADEMARK OFFICE

CERTIFICATE OF CORRECTION

PATENT NO. : 8,632,101 B2
APPLICATION NO. : 13/147532
DATED : January 21, 2014
INVENTOR(S) : Mallol et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 40 days.

Signed and Sealed this
Twenty-second Day of September, 2015

Michelle K. Lee

Michelle K. Lee
*Director of the United States Patent and Trademark Office*